US012214243B2

(12) United States Patent
Larson et al.

(10) Patent No.: US 12,214,243 B2
(45) Date of Patent: Feb. 4, 2025

(54) PORTABLE EXERCISE DEVICE

(71) Applicant: 2-B-Fit LLC, Highlands Ranch, CO (US)

(72) Inventors: Alan Gene Larson, Highlands Ranch, CO (US); Michael Walker Larson, Highlands Ranch, CO (US); Trent Evan Garner, Highlands Ranch, CO (US)

(73) Assignee: 2-B-Fit LLC, Highlands Ranch, CO (US)

( * ) Notice: Subject to any disclaimer, the term of this patent is extended or adjusted under 35 U.S.C. 154(b) by 150 days.

(21) Appl. No.: 17/992,713

(22) Filed: Nov. 22, 2022

(65) Prior Publication Data

US 2023/0082015 A1 Mar. 16, 2023

Related U.S. Application Data

(63) Continuation-in-part of application No. 17/245,966, filed on Apr. 30, 2021, now Pat. No. 11,779,796.

(60) Provisional application No. 63/019,269, filed on May 2, 2020.

(51) Int. Cl.
*A63B 21/00* (2006.01)
*A63B 21/015* (2006.01)

(52) U.S. Cl.
CPC ..... *A63B 21/4001* (2015.10); *A63B 21/015* (2013.01); *A63B 21/153* (2013.01)

(58) Field of Classification Search
CPC . A63B 21/4001; A63B 21/015; A63B 21/153; A63B 21/00069; A63B 21/012; A63B 21/157; A63B 2022/0041; A63B 21/154; A63B 21/4009; A63B 21/4017; A63B 21/4007
See application file for complete search history.

(56) References Cited

U.S. PATENT DOCUMENTS 3,995,853 A * 12/1976 Deluty ..... A63B 21/00069 482/123
4,174,832 A * 11/1979 Thompson ..... A63B 21/4043 482/127
4,484,741 A * 11/1984 Bingisser ..... A63B 21/153 482/114
4,779,866 A * 10/1988 Marshall ..... A63B 21/00069 482/116
4,871,165 A * 10/1989 Marshall ..... A63B 21/00069 482/116
6,149,559 A * 11/2000 Mackey ..... A63B 21/16 482/904
8,556,783 B1 * 10/2013 Ihli ..... A63B 21/4035 482/44
10,512,812 B2 * 12/2019 Krull ..... A63B 21/4043
2015/0011368 A1 * 1/2015 Manor ..... A63B 23/1209 482/116

* cited by examiner

*Primary Examiner* — Megan Anderson
*Assistant Examiner* — Andrew M Kobylarz
(74) *Attorney, Agent, or Firm* — Armstrong Teasdale LLP

(57) ABSTRACT

A portable exercise device that may be arranged in a number of different orientations and positions on the body of an individual. The portable exercise device includes a resistance assembly that enables a resistance of the portable exercise device to be adjusted.

18 Claims, 10 Drawing Sheets

PORTABLE EXERCISE DEVICE

CROSS-REFERENCE TO RELATED APPLICATION

The present application claims priority to, and is a continuation-in-part of, U.S. Non-provisional application Ser. No. 17/245,966 filed Apr. 30, 2021, and titled "Portable Exercise Device" which claims priority to U.S. Provisional Application No. 63/019,269, filed on May 2, 2020, and titled "Portable Exercise Device" the entire disclosures of which are hereby incorporated by reference in their entirety.

BACKGROUND

More and more individuals are exercising to maintain their health. However, between travel, work, school and other activities, it may be difficult for an individual to find time to exercise. Additionally, workout equipment may be expensive and an individual may need to buy various different exercise devices to exercise different parts of her body.

SUMMARY

The present application describes an exercise device that may be portable and/or be worn by an individual. In an example, the exercise device may be worn by the individual in a number of different configurations and/or orientations. Additionally, at least a portion of the exercise device may be moveable and/or rotatable such that the individual has a number of different options regarding the types of exercises being performed. The exercise device may be used by the individual to increase the individual's muscle tone and total body fitness.

In some examples, the portable exercise device may be worn on or around the front or back of the waist. In other examples, the portable exercise device may be worn on or around the individual's waist, chest, side and/or back. In yet another example, one component or portion of the portable exercise device may be removably coupled to another component or portion of the portable exercise device. In each of these arrangements, the portable exercise device provides resistance training to the individual's arms, legs, shoulders, feet, stomach, and back.

The portable exercise device includes a resistance assembly that may be used to increase and/or decrease the resistance provided by the portable exercise device. In an example, the resistance assembly includes a tension mechanism adapted to rotate about an axis. The resistance assembly also includes a gear assembly that includes a plurality of stators, a plurality of friction discs between the plurality of stators and a brake rotor positioned between the plurality of friction discs. In an example, the resistance assembly also includes a drive sheave rotatably coupled to a shaft. The shaft extends at least partially through a housing of the resistance assembly and mates with the brake rotor.

The present application also describes a resistance assembly for a portable exercise device. The resistance assembly includes a housing, a tension mechanism rotatably coupled to the housing and a gear assembly positioned between the housing and the tension mechanism. The gear assembly includes a plurality of stators, a plurality of friction discs between the plurality of stators and a brake rotor positioned between the plurality of friction discs. In an example, a drive sheave is rotatably coupled to a shaft that extends, at least partially, through a portion of the housing and mates with the brake rotor. A cord housing extends from the housing and a cord, associated with the drive sheave, extends, at least partially, through the cord housing.

Also described is a resistance assembly for a portable exercise device. The resistance assembly includes a housing, a tension mechanism rotatably coupled to an outer surface of the housing via one or more threads and a gear assembly. In an example, the gear assembly is configured to compress and decompress in response to rotation of the tension mechanism. The gear assembly is contained between the housing and the tension mechanism and includes a plurality of stators, a plurality of friction discs between the plurality of stators and a brake rotor positioned between the plurality of friction discs. The resistance assembly also includes a drive sheave rotatably coupled to a shaft. The shaft extends at least partially through a portion of the housing and mates with the brake rotor. The resistance assembly also includes a cord housing that extends from the housing.

BRIEF DESCRIPTION OF THE DRAWINGS

Non-limiting and non-exhaustive examples are described with reference to the following Figures.

DETAILED DESCRIPTION

Figure 1A:
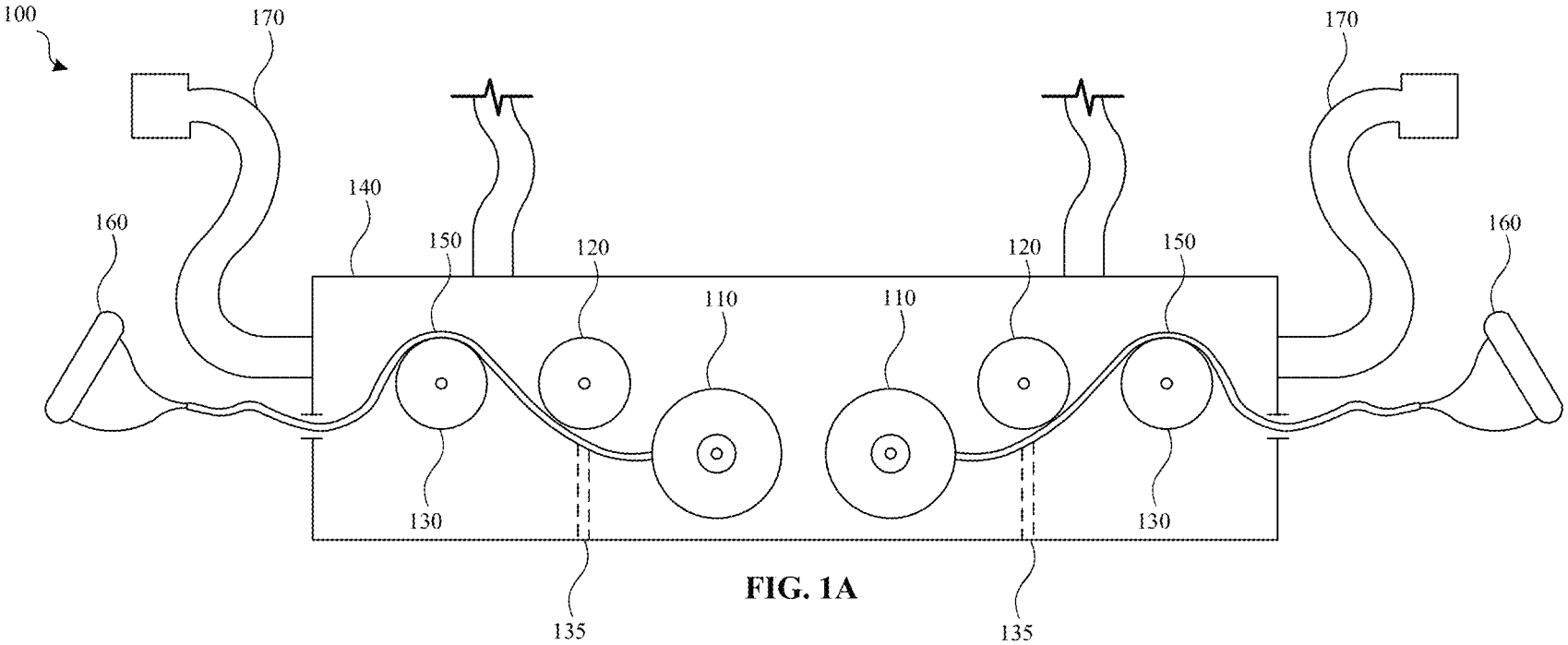
FIG. 1A illustrates a portable exercise device according to an example.

In the following detailed description, references are made to the accompanying drawings that form a part hereof, and in which are shown by way of illustrations specific embodiments or examples. These aspects may be combined, other aspects may be utilized, and structural changes may be made without departing from the present disclosure. Examples may be practiced as methods, systems or devices. Accordingly, examples may take the form of a hardware implementation, an entirely software implementation, or an implementation combining software and hardware aspects. The following detailed description is therefore not to be taken in a limiting sense, and the scope of the present disclosure is defined by the appended claims and their equivalents.

The present application describes a portable/wearable exercise device. The portable exercise device of the present application is configured such that an individual may wear the portable exercise device on different parts of her body and in different orientations. For example, the individual may wear the portable exercise device on her waist. In another example, the individual may wear the portable exercise device on or near her chest. In yet another example, the individual may wear the portable exercise device as a bandolier. Although specific examples are given, the portable exercise device of the present application may be configured to be worn on many different parts of a body of an individual based on the desires of the individual. Additionally, each orientation or position of portable exercise device may enable the individual to perform a number of different exercises.

The portable exercise device may also be "reversable." For example, the portable exercise device may be worn on a back side of the individual or a front side of the individual. As such, the portable exercise device may enable the individual to exercise various parts of her body—all with a single device. For example, and depending on how the individual arranges the portable exercise device, the individual may connect the cords to her arms or legs and perform a number of different exercises and select a number of different resistance levels.

The portable exercise device includes a securement mechanism such as a belt, a strap, a harness or other such mechanism that enables the portable exercise device to be removably secured on a portion of a body (e.g., a waist) of the individual. The wearable exercise device also includes an attachment mechanism that enables a housing and tension assembly to be coupled to the securement mechanism. In an example, the housing and the tension assembly may be moveable along and/or removably coupled to the securement mechanism. For example, the securement mechanism may include an attachment mechanism (e.g., a rail, one or more protrusions) that enables the housing and the tension assembly to be coupled thereto. The housing assembly may be movable around its axis so as to enable a handle extending from the housing to be manipulated in a number of different angles and/or directions.

These and other examples will be shown in more detail with respect to FIG. 1A-FIG. 10.

FIG. 1A illustrates a portable exercise device 100 according to an example. The portable exercise device 100 may include a number of different resistance mechanisms. For example, the portable exercise device 100 may include a first resistance mechanism 110, a second resistance mechanism 120 and a third resistance mechanism 130. Although three different resistance mechanisms are shown, the portable exercise device 100 may include any number of different resistance mechanisms. In some examples, the individual may add resistance mechanisms to, or remove resistance mechanisms from, the portable exercise device 100.

As shown in FIG. 1A, the portable exercise device includes a set of first resistance mechanisms 110, a set of second resistance mechanisms 120, and a set of third resistance mechanisms 130. The resistance mechanisms (and other components of the portable exercise device) may be used for different sides of the body of the individual. For example, a first set of resistance mechanisms, a handle 160, a cord 150, etc., may be used for the left side of individual's body (e.g., left arm, left leg, etc.) and a second set of resistance mechanisms, handle 160, cord 150, etc. may be used for the right side of the individual's body (e.g., right arm, right leg, etc.).

In some examples, the first resistance mechanism 110 may be a retractable spring reel, a spring-loaded pulley or other such mechanical mechanism/device that enables a cord 150 to be wound and unwound therefrom in response to movement of an individual. For example, as the individual extends her right arm and/or left arm, a corresponding first resistance mechanism 110 moves about an axis or otherwise rotates in a particular direction to unwind the cord 150 from the first resistance mechanism 110 thereby extending the length of the cord 150. As the individual retracts her right arm and/or left arm, the corresponding first resistance mechanism 110 moves about an axis or otherwise rotates in an opposite direction to wind the cord 150 onto or within the first resistance mechanism 150 thereby shortening the overall length of the cord 150.

Figure 1B:
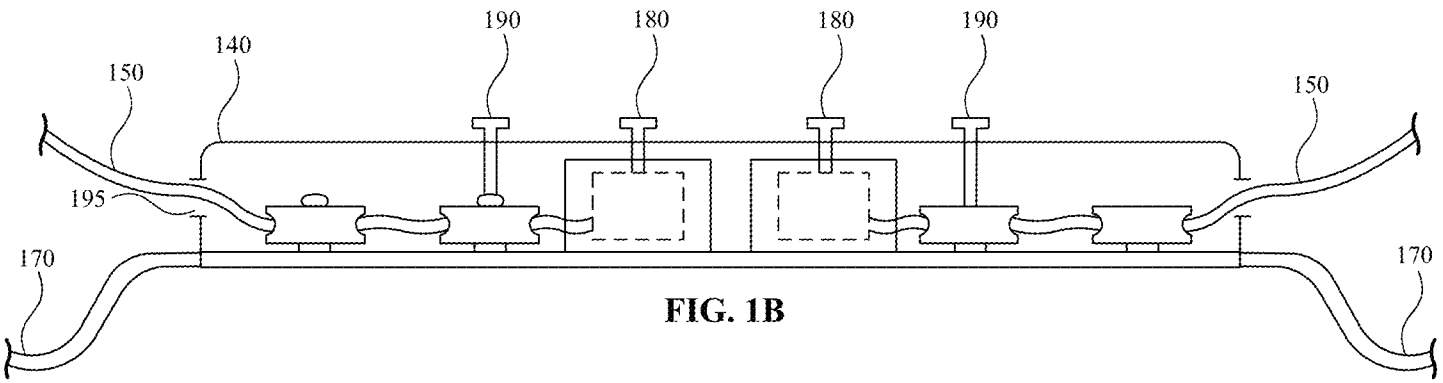
FIG. 1B illustrates a top view of the portable exercise device of FIG. 1A according to an example.

Referring to FIG. 1B, the first resistance mechanism 110 may include or otherwise be associated with a tension mechanism 180. The tension mechanism 180 may be a mechanical device, such as a dial or other such mechanical device or actuation mechanism. When actuated, the tension mechanism 180 increases or decreases tension associated with or otherwise provided by the first resistance mechanism 110. For example, as the tension mechanism 180 is actuated, a spring tension of a spring associated with or otherwise integrated with the first resistance mechanism 110 may increase or decrease. As such, rotational movement of the first resistance mechanism 110 may be impeded/restricted to increase resistance or may be facilitated/permitted to decrease resistance.

Referring back to FIG. 1A, the portable exercise device 100 may also include one or more additional resistance mechanisms. For example and as shown in FIG. 1A, the portable exercise device 100 includes a second resistance mechanism 120 and a third resistance mechanism 130. Each of the second resistance mechanism 120 and the third resistance mechanism 130 may be pulley type mechanisms. As such, the second resistance mechanism 120 and/or the third resistance mechanism 130 may include a rim or edge that guides the cord 150 as the cord 150 unwinds from or winds onto/within the first resistance mechanism 110. Although not shown in FIG. 1A, the cord 150 may be wrapped substantially around or entirely around the second resistance mechanism 120 and/or the third resistance mechanism 130 to increase the resistance for the individual. In another example, the cord 150 may be removed from the second resistance mechanism 120 and/or the third resistance mechanism 130 to decrease the resistance.

In some examples, the second resistance mechanism 120 and/or the third resistance mechanism 130 may be associated with or otherwise moveably coupled to a track 135. The track 135 enables a position of the second resistance mechanism 120 and/or the third resistance mechanism 130 to be adjusted by the individual. The position of the resistance mechanisms may be adjusted in any direction (e.g., up, down, left, right, diagonally, etc.) so long as the track 135 extends in the desired direction. In some example, the position and/or orientation of the track 135 may be adjusted. In another example, the portable exercise device may have multiple tracks 135 and each track 135 may be positioned in a different orientation. As the individual adjusts the position of the second resistance mechanism 120 and/or the third resistance mechanism 130, the resistance for the individual may increase or decrease accordingly.

As shown in FIG. 1B, the second resistance mechanism 120 (and/or the third resistance mechanism 130) may be associated with an adjustment mechanism 190. The adjustment mechanism 190 may be a mechanical device such as a dial or other such device that, when actuated, causes the resistance mechanisms (e.g., the second resistance mechanism 120) to move along the track 135. In some examples, actuation of the adjustment mechanism 190 may also impede/restrict or facilitate/permit rotational movement of the second resistance mechanism 120. For example, actuation of the adjustment mechanism 190 in one direction may cause an increase in the tension on the second resistance mechanism 120. As such, resistance felt by the individual may increase. Likewise, actuation of the adjustment mechanism 190 in a different direction may decrease tension on the second resistance mechanism 120. As such, resistance felt by the individual may decrease.

In some examples, the first resistance mechanism 110, the second resistance mechanism 120 and the third resistance mechanism 130 (and tension mechanism 180 and the adjustment mechanism 190) may be enclosed within or otherwise contained in a pouch 140 or other such housing. The pouch 140 may define an opening 195 (FIG. 1B) that enables the cord 150 to pass therethrough. The opening 195 may be sized to enable the cord 150 to pass through but may be configured to prevent an accessory 160, such as a handle, from entering the pouch 140. In some examples, the opening 195 may include a grommet or other such mechanism that facilitates movement of the cord 150 through the opening 195 thereby reducing wear and tear of the pouch 140 and/or the cord 150.

The pouch 140 may be made of any suitable material (e.g., nylon, canvas etc.). The pouch 140 may be flexible which allows the pouch 140 to be placed on many different positions/locations on the individual. The pouch 140 and/or the portable exercise device 100 may include padding to provide additional comfort to the individual. The pouch 140 may also include one or more structured support mechanisms that provide support for the various resistance mechanisms.

The pouch 140 may also include a zipper or other device that enables the pouch 140 to be opened and closed. As such, the individual may access the various resistance mechanisms within the pouch 140. In some examples, resistance mechanisms may be added to or removed from the portable exercise device 100. In other examples, the individual may manually (or mechanically) adjust a travel path of the cord 150 to adjust the resistance provided by the portable exercise device 100.

For example, the individual may remove the cord 150 from traveling around the third resistance mechanism 150 in order to decrease resistance. In another example, the individual may add an additional resistance mechanism to the portable exercise device 100 and arrange the cord 150 such that the cord 150 is threaded through or otherwise actuates each of the resistance mechanisms which may subsequently increase resistance. As such, the individual may need access to the inside of the pouch 140.

As briefly discussed above, the portable exercise device 100 may also include an accessory 160. In the example shown, the accessory 160 is a handle. The accessory 160 may be removably coupled to the cord 150 such that an individual may be able to switch accessories depending on the desired type of exercises. For example, if the individual wants to exercise her arms, handles may be removably coupled to the cord 150. If the individual wants to exercise her legs, one or more straps may be removably coupled to the cord 150 and subsequently secured to the individual's feet or ankles. Although specific examples are given, other accessories 160 may be removably coupled to the cord 150 such as, for example, weights, walking/hiking poles, and so on.

In some examples, the accessory 160 may include a dial or other actuation mechanism (similar to tension mechanism 180 and adjustment mechanism 190) that enables the individual to adjust the resistance/tension of the portable exercise device 100. In examples in which the tension mechanism 180 and/or the adjustment mechanism 190 are included with an accessory 160, the tension mechanism 180 and the adjustment mechanism 190 may be removed from the first resistance mechanism 110 and/or the second resistance mechanism 120.

The portable exercise device 100 may also include one or more straps 170. The straps 170 may be adjustable and may be used to secure the portable exercise device 100 to the individual. For example, the portable exercise device 100 may include straps 170 that fit around a waist of the individual. In another example, shoulder straps may be used to secure the portable exercise device 100 around the chest and/or shoulders of the individual. In some examples, the straps 170 may be removably coupled to the pouch 140.

Figure 2A:
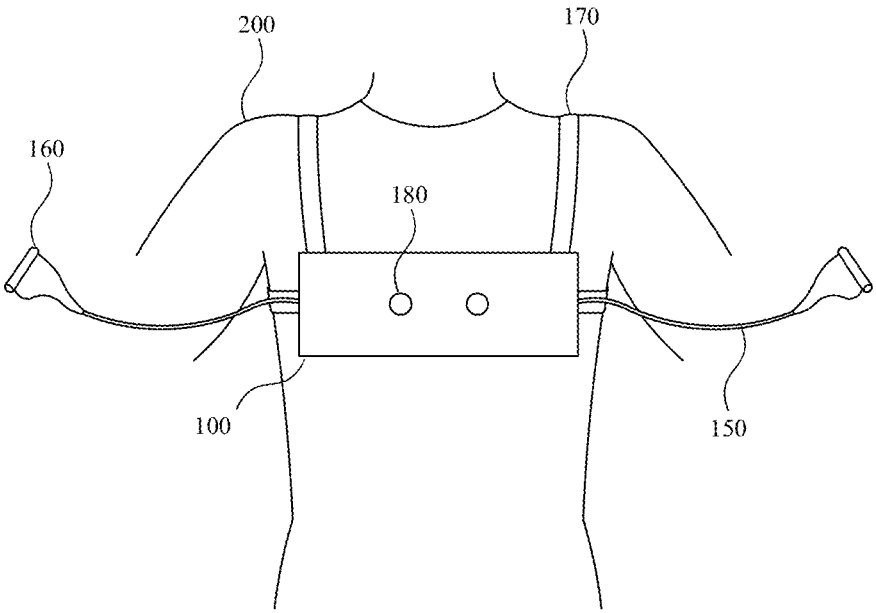
FIG. 2A-FIG. 2B illustrate the portable exercise device of FIG. 1A being worn by an individual in a first configuration according to an example.
Figure 2B:
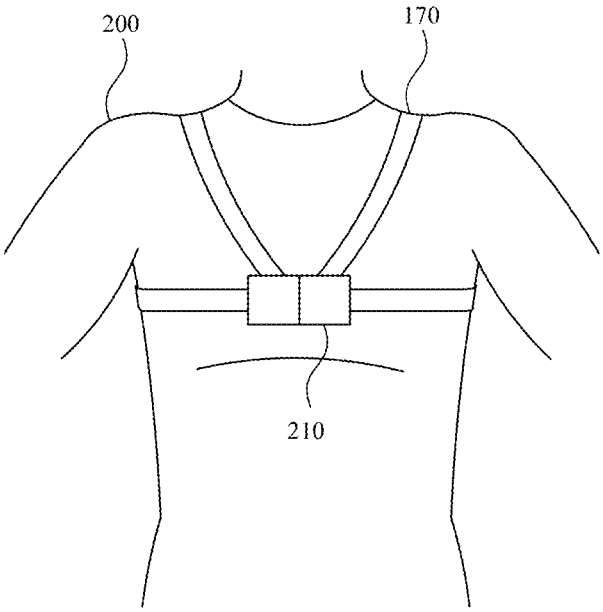

FIG. 2A-FIG. 2B illustrate the portable exercise device 100 of FIG. 1A being worn by an individual 200 in a first configuration according to an example. As shown in FIG. 2A-FIG. 2B, the portable exercise device 100 may be positioned on or near the chest of the individual 200. In some examples, the straps 170 of the portable exercise device may include a clip 210 or other such fastener that secures the portable exercise device 100 to the individual. As also discussed above, the portable exercise device 100 may be reversable such that the portable exercise device 100 may be positioned on a side of the individual 200, a front side of the individual 200 or a back side of the individual 200. Each of the different locations may enable the individual 200 to perform a number of different exercises.

Figure 3A:
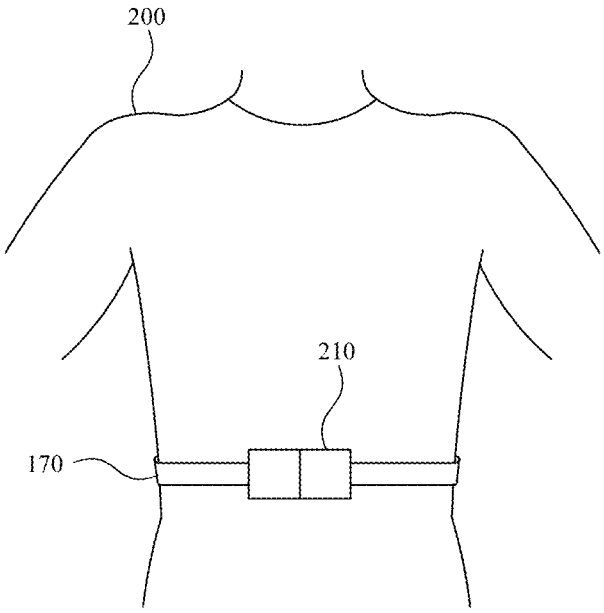
FIGS. 3A-FIG. 3B illustrate the portable exercise device of FIG. 1A being worn by an individual in a second configuration according to an example.
Figure 3B:
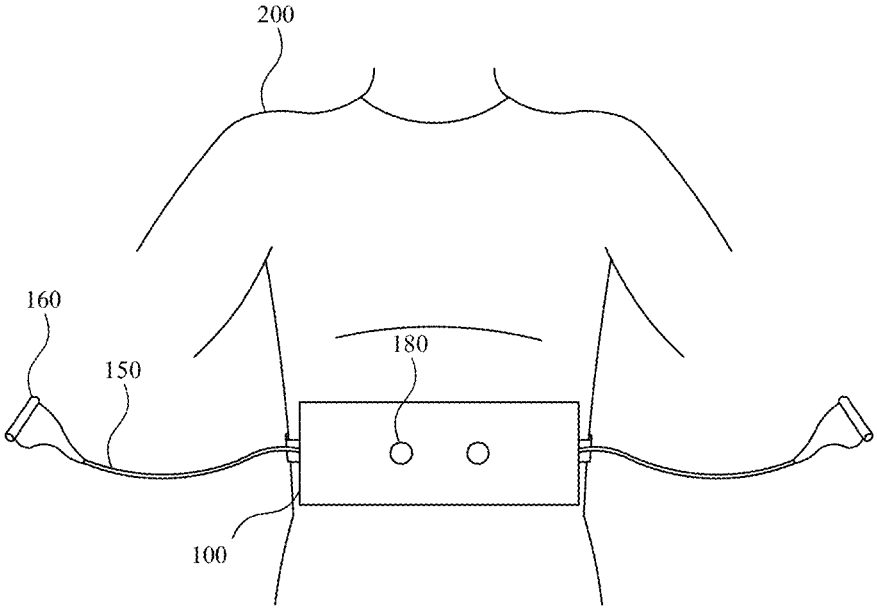

FIG. 3A-FIG. 3B illustrate the portable exercise device 100 of FIG. 1A being worn by the individual 200 in a second configuration according to an example. In this example, the individual 200 is wearing the portable exercise device 100 around his waist. Like the example shown in FIG. 2A-FIG. 2B, the portable exercise device 100 has been secured to the waist of the individual 200 using the straps 170 and clip 210.

Figure 4A:
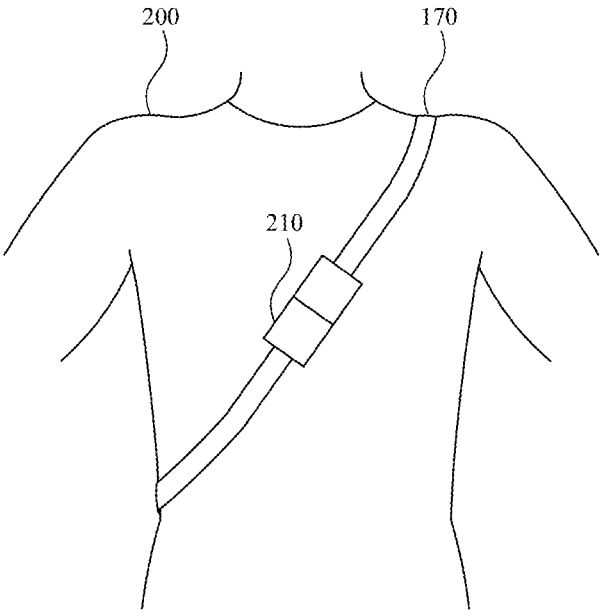
FIG. 4A-FIG. 4B illustrate the portable exercise device of FIG. 1A being worn by an individual in a third configuration according to an example.
Figure 4B:
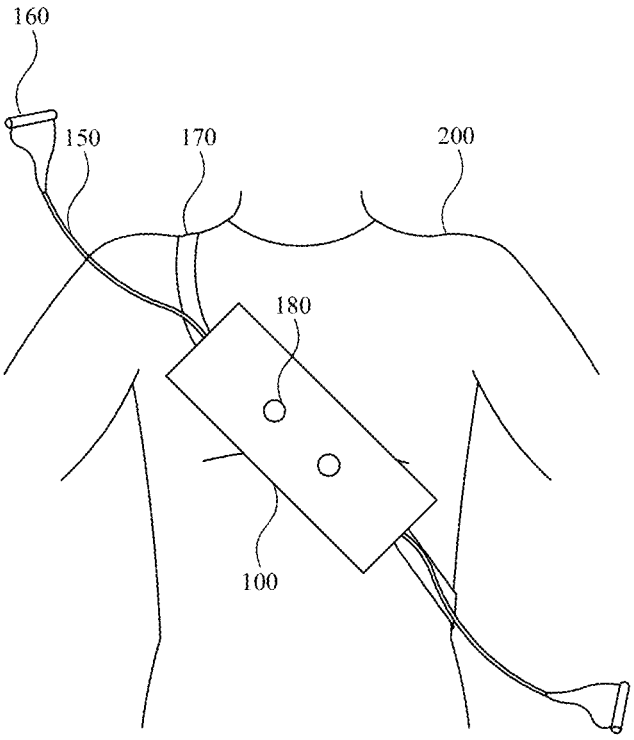

FIG. 4A-FIG. 4B illustrate the portable exercise device 100 of FIG. 1A being worn by the individual 200 in a third configuration according to an example. In this configuration, the portable exercise device 100 is secured to the individual 200 as a bandolier. Like the other examples previously described and shown, the arrangement/position of the portable exercise device 100 in this configuration may enable the individual 200 to perform a number of different exercises.

Although FIG. 2A-FIG. 4B show the portable exercise device 100 in specific orientations and positions, the portable exercise device 100 may be positioned or arranged in a number of different orientations and positions on the body of the individual 200. Each position/orientation may enable the individual to perform exercises on her arms, legs, abs, shoulders, etc. at varying resistance levels.

Figure 5A:
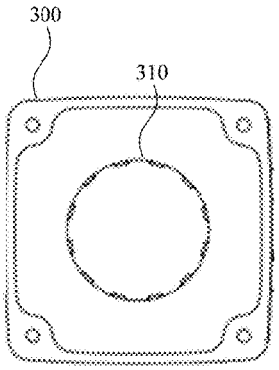
FIG. 5A illustrates an example resistance assembly that may be used to provide resistance for a portable exercise device according to an example.
Figure 5C:
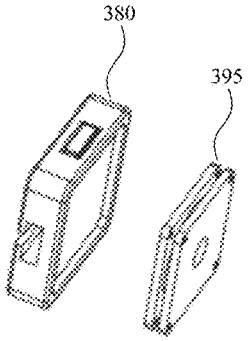
FIG. 5C illustrates additional components of the resistance assembly of FIG. 5A according to an example.
Figure 5B:
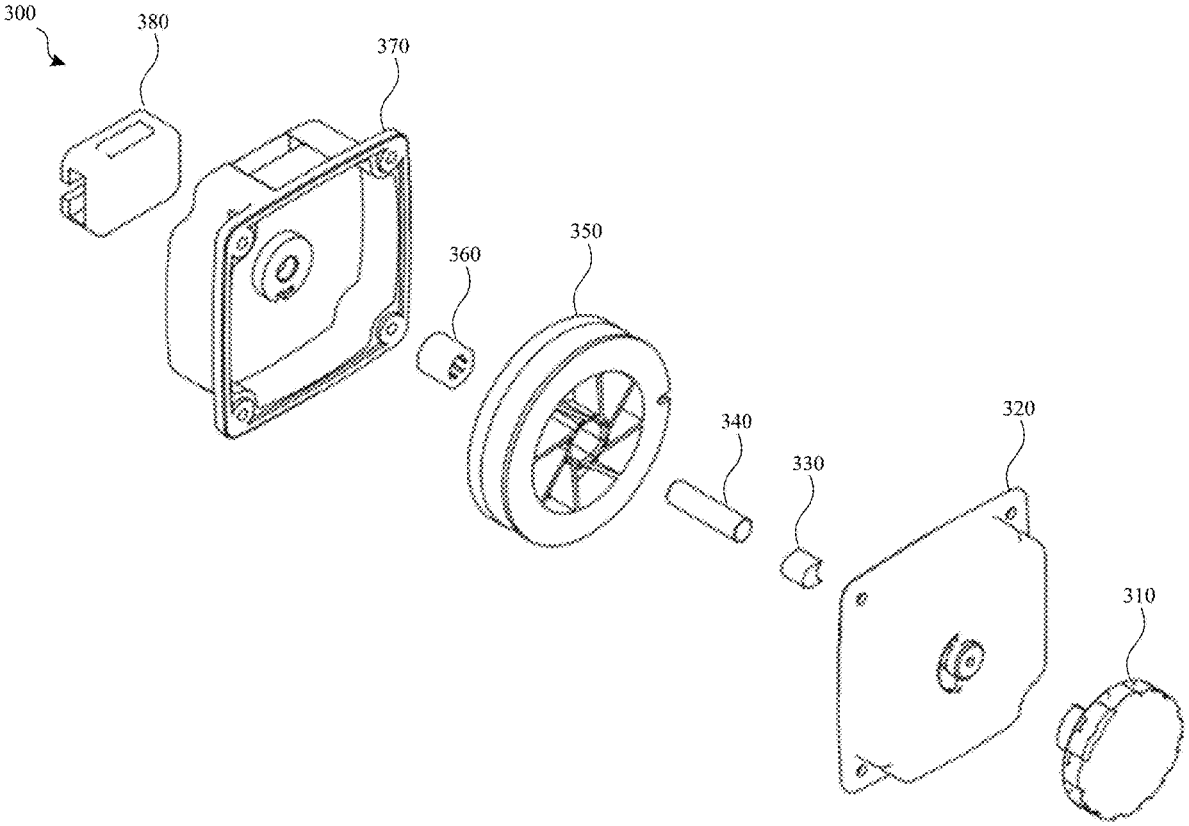
FIG. 5B illustrates an exploded view of the resistance assembly of FIG. 5A according to an example.

FIG. 5A and FIG. 5B illustrate an example resistance assembly 300 that may be used to provide resistance for a portable exercise device according to an example. The resistance assembly 300 may be used with the portable exercise device 100 shown and described with respect to FIG. 1A-FIG. 4B. Additionally, the resistance assembly 300 may be used as part of, or in lieu of, the first resistance mechanism 110, the second resistance mechanism 120 and/or the third resistance mechanism 130. For example, the portable exercise device 100 may use a single resistance assembly 300. In another example, multiple resistance assemblies 300 (or portions of the resistance assembly 300) may be used as the various resistance mechanisms shown and described herein.

As shown in FIG. 5A, the resistance assembly 300 may include a tension mechanism 310. The tension mechanism 310 may be similar to the tension mechanism 180 shown and described with respect to FIG. 1B. The tension mechanism 310 may be a dial, a knob, a key, or other device that enables an individual to increase or decrease a tension associated with or otherwise provided by the resistance assembly 300. For example, if the tension mechanism 310 is rotated in a clockwise direction, a tension provided by the resistance mechanism 300 may increase. Likewise, if the tension mechanism 310 is rotated in a counter-clockwise direction, the tension provided by the resistance assembly 300 may decrease.

Although a rotation of the tension mechanism 310 is specifically mentioned, other processes of increasing and/or decreasing tension provided by the resistance assembly 300 may be used. For example, moving the tension mechanism 310 in an inward direction (e.g., in response to an individual pushing or pressing the tension mechanism 310) may cause the tension to increase and/or decrease. As will be explained in greater detail below with respect to FIG. 6A-6C, the resistance assembly 300 may be slidably or otherwise moveably coupled to belt, strap or other securement mechanism.

FIG. 5B illustrates an exploded view of the resistance assembly 300 of FIG. 5A according to an example. As described above, the resistance assembly 300 includes a tension mechanism 310 or other such adjustment knob. The resistance assembly 300 may also include an outer housing 320 and an inner housing 370. The outer housing 320 and the inner housing 370 may form an enclosure into which various components of the resistance assembly 300 may be assembled or otherwise contained.

The resistance assembly 300 may also include a drive sheave 350. The drive sheave 350 may be configured to have a cord (e.g., cord 150 (FIG. 1)), cable, rope etc., wind and unwind therefrom in response to movement by the individual. In an example, the drive sheave 350 is rotatably coupled to a resistance shaft 340. For example, the drive sheave 350 and shaft may rotate about an axis as the cord is wound onto and unwound from the drive sheave 350 in response to movement by the individual.

The resistance assembly 300 may also include a brake pad 330. The brake pad 330 may be used to increase or decrease the tension provided by the resistance assembly 300. For example, as the tension mechanism 310 is rotated in a clockwise direction, the brake pad 330 may move toward and/or contact the resistance shaft 340. As the brake pad 330 moves, it contacts the resistance shaft 340. As such, a rotation of the resistance shaft 340 and the drive sheave 350 may be more restricted thereby increasing the resistance/tension. Likewise, as the tension mechanism 310 is rotated in a counter-clockwise rotation and the brake pad 330 moves away from and/or does not contact the resistance shaft 340, the resistance provided by the resistance assembly 300 decreases.

In another example, the resistance assembly 300 may include a slipper clutch. The slipper clutch may be used as a friction brake that provides resistance to the resistance shaft 340. In an example, the slipper clutch may rub or otherwise contact the resistance shaft 340 and cause energy to dissipate due to friction caused by the contact. In an example, a resistance mechanism (e.g., a nut) can be tightened to provide a constant amount of resistance. The resistance mechanism may be coupled to and/or integrated with the tension mechanism 310 so that the individual can adjust the amount of resistance while exercising.

The resistance assembly 300 may also include a bearing 360. In an example, the bearing 360 is a one-way bearing. As such, the bearing 360 engages drive sheave 350 and the resistance shaft 340 in a single direction. For example, the bearing 360 may engage the drive sheave 350 and the resistance shaft 340 on a resistance stroke (e.g., as the cord unwinds from the drive sheave in response to movement by an individual). However, when the resistance stroke is complete and the cord is to be wound onto the drive sheave 350 again, the bearing 360 enables the drive sheave 350 (but not the resistance shaft 340) to rotate about its axis. In an example, a coil spring or other mechanism may be used to wind the cord back onto the drive sheave 350 once the resistance stroke has been completed.

The resistance assembly 300 may also include a sliding mechanism 380 or other adjustment mechanism coupled to the inner housing 370. The sliding mechanism 380 enables the resistance assembly 300 to be moveably, rotatably and/or releasably coupled to a securement mechanism such as, for example a belt, a strap, a harness and the like.

FIG. 5C illustrates additional components of the resistance assembly 300 of FIG. 5A according to an example. In the example shown in FIG. 5C, the sliding mechanism 380 may define an opening in which a rotation mechanism 395 may be associated or integrated with. The rotation mechanism 395 may enable the resistance assembly to rotate about its axis (e.g., such as shown and described by the directional arrow 450 (FIG. 6B)). As discussed above, the sliding mechanism 380 may enable the resistance assembly 300 to move along a belt, strap, harness, etc.

Figure 6B:
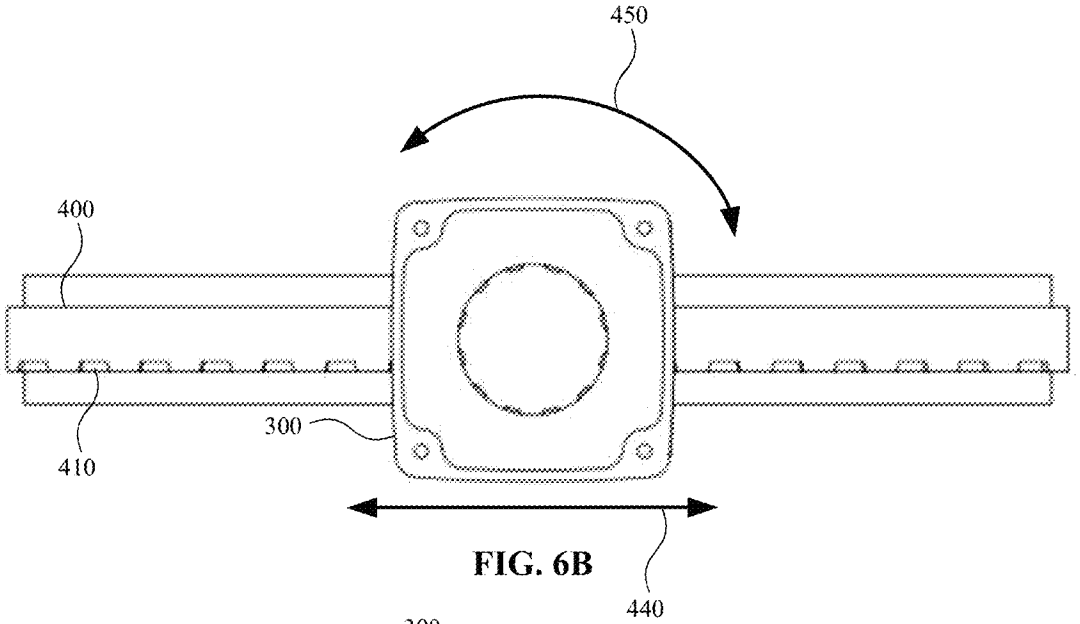
FIG. 6A-FIG. 6C illustrate an example resistance assembly being coupled to a rail according to an example.
Figure 6C:
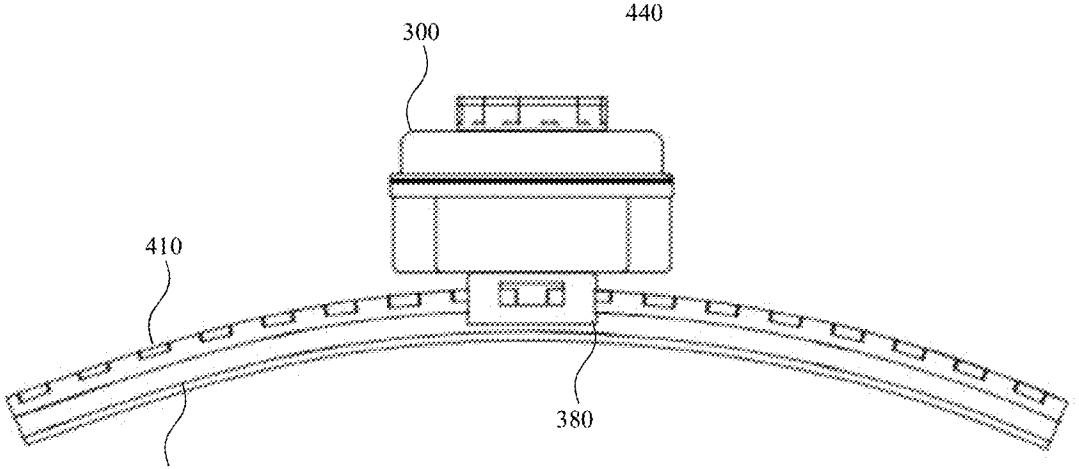
Figure 6A:
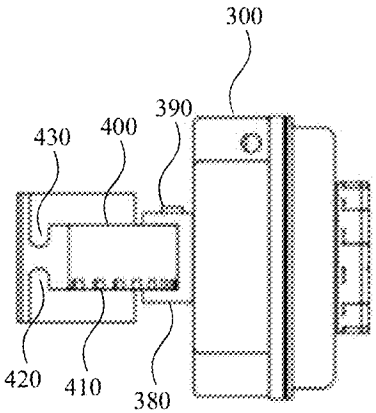

For example and referring to FIG. 6A-FIG. 6C, the resistance assembly 300 may be moveably coupled to a rail 400 via the sliding mechanism 380. In an example, the rail 400 may be coupled to or otherwise integrated with a belt, strap or other securement mechanism. The rail 400 may define opposing channels 420 and 430. The channels 420 and 430 may receive and/or secure at least a portion of the sliding mechanism 380 while enabling the sliding mechanism 380 and the resistance mechanism 300 to move (e.g., laterally) along a length of the rail 400 such as shown by directional arrow 440.

The rail 400 may also define one or more indentations 410 or teeth. In an example, a locking mechanism 390 associated with the sliding mechanism 390 may secure the resistance assembly at a particular location along the rail 400. The locking mechanism 390 may be a spring-loaded locking mechanism that engages with and/or disengages from the indentation 410 in response to actuation by the individual. Although the indentations are shown having a particular shape and location, the indentations 410 may have any shape (e.g., holes, half-circles, triangular) and be located at a number of different locations along the rail 400.

As also shown in FIG. 6B, the resistance mechanism 300 may be rotatable around an axis 450. For example, the resistance mechanism 300 may be rotatably coupled to the sliding mechanism 380. Thus, the resistance mechanism may rotate about its axis as the individual extends, retracts, or otherwise utilizes the resistance assembly 300. As such, the individual is free to use the portable exercise device in any of a number of continuous angles about an axis of the resistance mechanism 300.

The resistance mechanism 300 and/or the sliding mechanism 380 may also include another locking mechanism that locks the rotational angle of the resistance mechanism at particular angles. For example, the locking mechanism may secure the resistance assembly at a ninety-degree angle with respect to the individual to enable the individual to perform particular extension exercises at that given angle.

FIG. 6C illustrates another view of the resistance assembly 300 being moveably coupled to the rail 400. In an example, the rail 400 is flexible which allows the exercise device to be positioned at various locations on a body of the individual. Additionally, the exercise device described herein can be used by individuals with different body types.

Figure 7A:
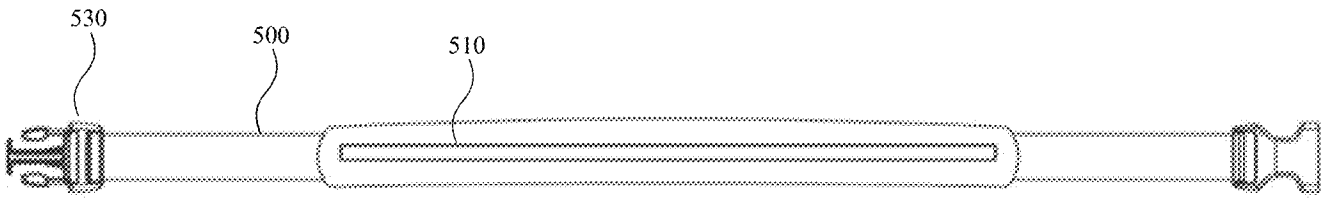
FIG. 7A-FIG. 7B illustrate additional example securement mechanisms that may be used with the resistance assembly described herein
Figure 7B:
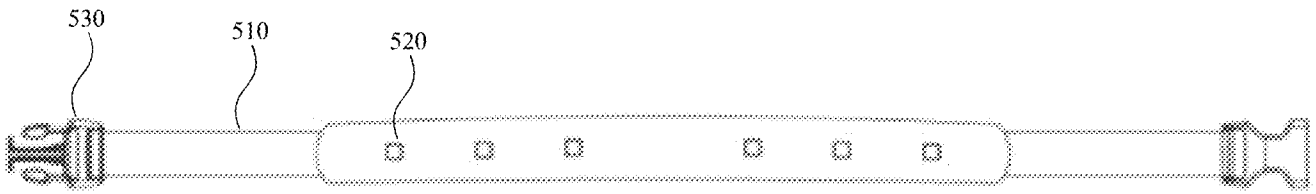

FIG. 7A-FIG. 7B illustrate example securement mechanisms 500 that may be used with the resistance assembly described herein. Each securement mechanism 500 may be a belt, strap, harness or other wearable device that may be used to removably couple the portable exercise device described herein to an individual. The securement mechanism 500 may be made from any suitable material such as nylon, leather, and the like. The securement mechanism 500 may include a clip 530.

The securement mechanism 500 shown in FIG. 7A includes a rail 510 that extends at least partially along a length of the securement mechanism 500. The rail 510 enables one or more resistance mechanisms to move along one more continuous or substantially continuous locations along a length of the rail 510. In an example, a sliding mechanism may include a locking mechanism that enables the resistance assembly to be positioned at any continuous or discrete locations along a length of the rail 510.

FIG. 7B shows another example in which the securement mechanism 510 has one or more protrusions 520. Each of the protrusions 520 may be used to receive and secure a resistance assembly thereon. For example, a resistance assembly may be removably and/or rotatably coupled to a particular protrusion 520.

Figure 8A:
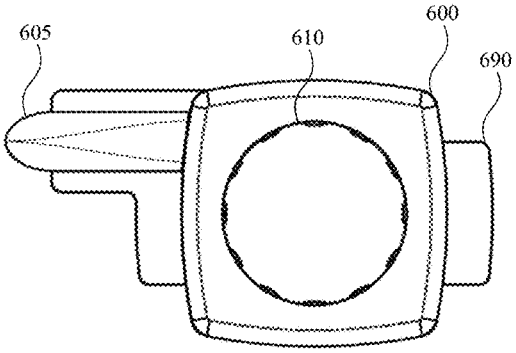
FIG. 8A illustrates an example resistance assembly that may be used to provide resistance for a portable exercise device according to another example.

FIG. 8A illustrates an example resistance assembly 600 that may be used to provide resistance for a portable exercise device according to another example. The resistance assembly 600 may be used with the portable exercise device 100 shown and described with respect to FIG. 1A-FIG. 4B. Additionally, the resistance assembly 600 may be used as part of, or in lieu of, the first resistance mechanism 110, the second resistance mechanism 120 and/or the third resistance mechanism 130. For example, the portable exercise device 100 may use a single resistance assembly 600. In another example, multiple resistance assemblies 600 (or portions of the resistance assembly 600) may be used as the various resistance mechanisms shown and described herein. In addition, the resistance assembly 600 may be used with the various securement mechanisms shown and described with respect to FIG. 7A-FIG. 7B.

In an example, the resistance assembly 600 includes a tension mechanism 610. The tension mechanism 610 may be similar to the tension mechanism 310 (FIG. 5A) and/or the tension mechanism 180 (FIG. 1B). The tension mechanism 610 may be a dial, a knob, a key, or other mechanism that enables an individual to increase or decrease a tension associated with or otherwise provided by the resistance assembly 600. For example, if the tension mechanism 610 is rotated in a clockwise direction, tension provided by the resistance mechanism 600 may increase. Likewise, if the tension mechanism 610 is rotated in a counter-clockwise direction, tension provided by the resistance assembly 600 may decrease.

In some examples, the tension mechanism 610 may enable various tension settings. The tension settings may be continuous or discrete. For example, any movement of the tension mechanism 610 may increase or decrease the tension. In another example, the tension mechanism 610 may have 3-5 (or any number) of discrete settings that are selectable by the individual. An audible noise (e.g., a "click") and/or haptic feedback may provide the individual with information regarding a particular setting. For example, as the individual turns the tension mechanism 610, an audible click may be heard after every quarter turn indicating a new setting has been reached. While specifics are given, this is for example purposes only.

Although a rotation of the tension mechanism 610 is specifically mentioned, other operations and/or methods may be used to increase and/or decrease the amount of tension provided by the resistance assembly 600. For example, the tension mechanism 610 may be pressed (e.g., in an inward direction) to increase and/or decrease the tension.

The tension mechanism 600 may also include a cord housing 605. The cord housing 605 may extend from at least one side of the tension mechanism 600. The cord housing 605 may have a first dimension at a proximal end and taper to a second dimension at a distal end. The cord housing 605 may be integrated with a housing of the tension mechanism 600. In another example, the cord housing 605 may be removably coupled to the housing of the tension mechanism 600.

The cord housing 605 may at least partially contain a cord (e.g., cord 150 (FIG. 1)) as the cord extends from and retracts into the tension mechanism 600. In an example, the cord may be fed into a protective tube (not shown). The protective tube may be at least partially contained within the cord housing 605. The cord housing 605 may include various features that enable the cord to be more easily pulled in different directions. These features will be described in more detail with respect to FIG. 8C.

The tension mechanism 600 may also include a flange 690 extending from the housing. The flange 690 may be on various sides of the housing. In another example, the flange 690 may extend substantially around or completely around the housing and/or the cord housing 605. The flange 690 may be used to secure the tension mechanism 600 to a securement mechanism.

Figure 8B:
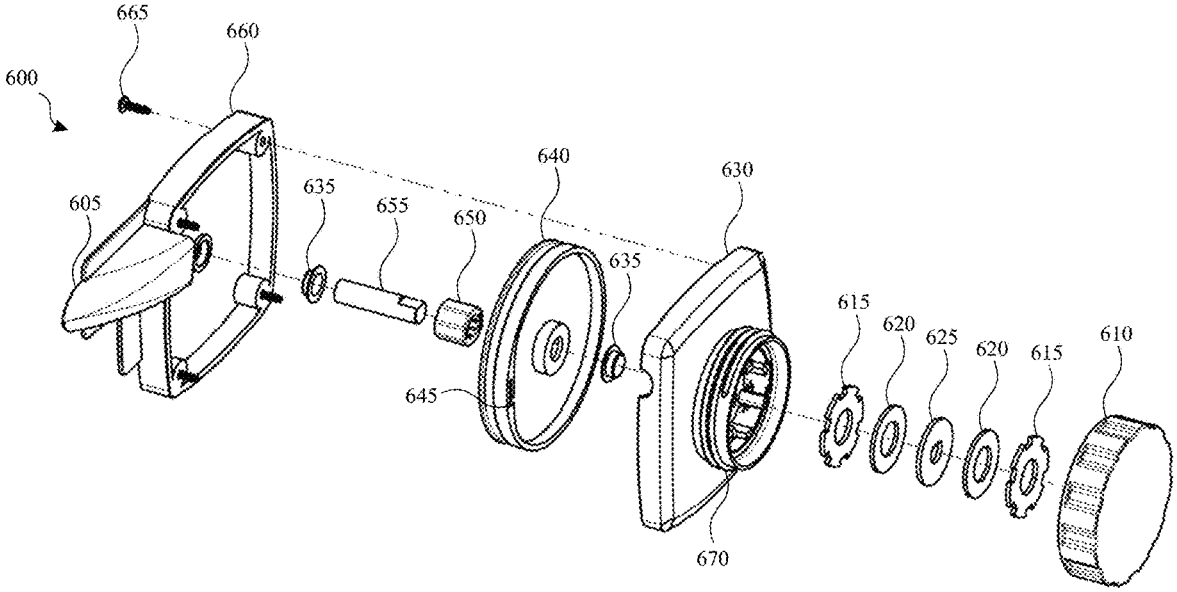
FIG. 8B illustrates an exploded view of the resistance assembly of FIG. 8A according to an example.

FIG. 8B illustrates an exploded view of the resistance assembly 600 of FIG. 8A according to an example. As shown in FIG. 8B, the resistance assembly 600 includes a tension mechanism 610 or other such adjustment feature. The resistance assembly 600 may also include an outer housing 630 and an inner housing 660. The outer housing 630 and the inner housing 660 may form an enclosure into which various components of the resistance assembly 600 are assembled or otherwise contained.

The resistance assembly 600 also includes a gear assembly. In an example, the gear assembly includes multiple stators 615 on opposing ends of the gear assembly. Each stator 615 acts as a stationary component of the gear assembly. For example, each stator 615 may include a number of teeth on an outside edge. In an example, the teeth of each stator mate with corresponding teeth within the outer housing 630. As such, each stator may remain stationary or substantially stationary. Each stator 615 may axially "float" within the outer housing 615 as the tension mechanism 610 is rotated to increase and decrease the tension. For example, as the tension mechanism 610 is actuated to increase the resistance, the gear assembly is compressed. Likewise, as the tension mechanism 610 is actuated to decrease the resistance, the gear assembly is decompressed.

The gear assembly also includes friction discs 620. As shown, the friction discs 620 may be positioned next to each stator 615 and on either side of a brake rotor 625. The friction discs 620 may be comprised of a felt material or other compressible or semi-compressible material that, when compressed on the brake rotor 625, impedes rotation of the brake rotor 625. In an example, the brake rotor 625 includes a "D" shape in its center that mates with a corresponding shape on a proximal end of shaft 655. Although a "D" shape is specifically shown and mentioned, the brake rotor 625 and the corresponding shaft 655 may have any shape.

The outer housing 630 also includes threads 670 or grooves. The threads 670 mate with the tension mechanism 610 and enable the tension mechanism 610 rotate about an axis. As explained above, as the tension mechanism rotates about the threads 670, the gear assembly either compresses or decompresses to increase or decrease the resistance of the resistance assembly 600. The resistance assembly 600 also includes one or more flanges 635. Each flange 635 may be used to help reduce friction between the various components of the resistance assembly 600.

The resistance assembly 600 also includes a drive sheave 640. The drive sheave 640 is configured to house a cord (e.g., cord 150 (FIG. 1)), cable, rope etc., that winds and unwinds therefrom in response to movement by the individual. In an example, the drive sheave 640 is rotatably coupled to a shaft 655. For example, the drive sheave 640 and shaft 655 may rotate about an axis as the cord is wound onto and unwound from the drive sheave 640 in response to movement by the individual. In an example, the drive sheave 640 includes a notch 645 that is used to engage a coil spring (not shown). A corresponding notch may be provided on an inside portion of the outer housing 630. In an example, the coil spring (or other mechanism) may be used to return the drive sheave 640 to its initial state (e.g., a state in which the cord is wound around the drive sheave 640).

The resistance assembly 600 may also include a bearing 650. In an example, the bearing 650 is a one-way bearing. As such, the bearing 650 engages the drive sheave 640 and the shaft 655 in a single direction. For example, the bearing 650 may engage the drive sheave 640 and the shaft 655 on a resistance stroke (e.g., as the cord unwinds from the drive sheave 640 in response to movement by an individual). However, when the resistance stroke is complete and the cord is to be wound back onto the drive sheave 640, the bearing 650 enables the drive sheave 640 (but not the shaft 655) to rotate about an axis. As explained above, a coil spring or other mechanism may be used to rotate the drive sheave 640 to its initial position once the resistance stroke has been completed which causes the cord to be wound onto the drive sheave 640. One or more screws 665 may secure the outer housing 630 to the inner housing 660.

Figure 8C:
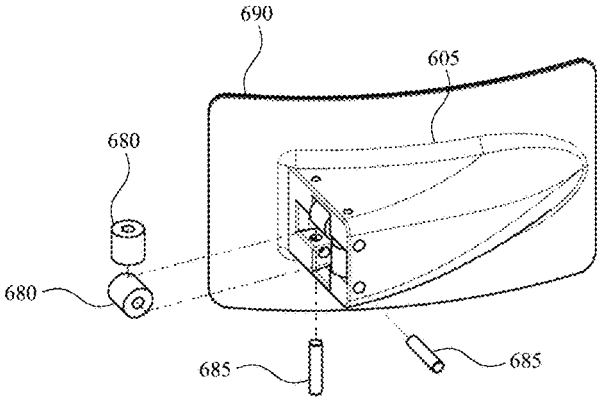
FIG. 8C illustrates an exploded view of a cord housing according to an example.
Figure 8D:
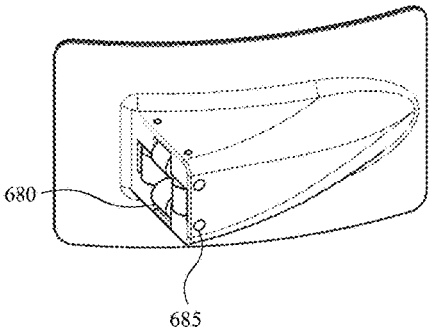
FIG. 8D illustrates an assembled view of the cord housing of FIG. 8C according to an example.

FIG. 8C and FIG. 8D illustrates features of a cord housing 605 according to an example. As shown, the cord housing 605 may include a plurality of bearings 680. The bearings 680 may be secured within the cord housing 605 using corresponding shafts 685. In an example, bearings 680 may rotate about the shafts 685 as the cord extends from an opening defined by the bearings 680. The bearings may be used to reduce friction on the cord housing 605 and/or the cord as the cord extends and retracts from the resistance assembly.

Figure 9A:
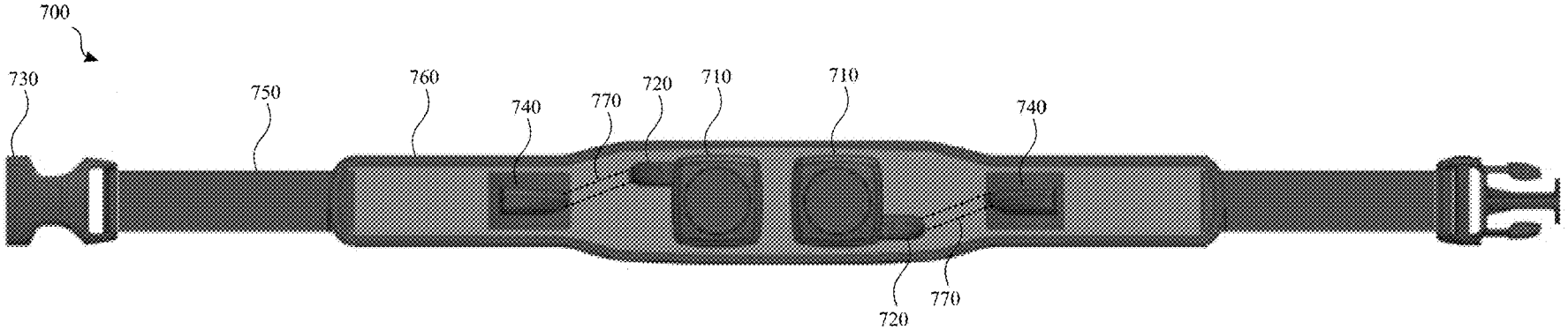
FIG. 9A illustrates a portable exercise device that may use the resistance assembly shown and described with respect to FIG. 8A-FIG. 8D according to an example.

FIG. 9A illustrates another example portable exercise device 700. The portable exercise device 700 may utilize a resistance assembly 710 such as described herein. In an example, the resistance assembly 710 may be similar to the resistance assembly 600 shown and described with respect to FIG. 8A-FIG. 8D.

As with other examples described herein, the portable exercise device 700 may include a securement mechanism 750. the securement mechanism 750 may be a belt, strap, harness or other wearable device that may be used to removably couple the portable exercise device 700 to an individual. The securement mechanism 700 may be made from any suitable material such as nylon, neoprene, leather, and the like. In an example, the securement mechanism may include multiple layers of the same or different materials. For example, a first layer and a second layer may be comprised of nylon, a third layer may include a webbed material while a fourth layer may be comprised of neoprene. The securement mechanism 750 may also include an edge treatment 760 that assist in secure some, or all, of the layers together. The edge treatment 760 may be made from plastic or any of the other materials listed above. The securement mechanism 700 may include a clip 730 or other fastener that may be used to enable the individual to secure the portable exercise device 700 to their person.

In an example, the resistance assembly 710 of the portable exercise device 700 may also include a cord housing 720. The cord housing 720 may be similar to the cord housing 605 shown and described with respect to FIG. 8A-FIG. 8D. For example, the cord housing 720 may extend from the resistance assembly 710 and contain a cord (represented by dashed lines 770). The cord may be similar to the cord 150 shown and described with respect to FIG. 1A.

In an example, the cord may extend from the resistance assembly 710, through the cord housing 720 and extend out of second cord housing 740. The second cord housing 740 may include similar features of the cord housing 720. That is, the second cord housing 740 may include a plurality of bearings and shafts such as described with respect to FIG. 8C-FIG. 8D.

In some examples, at least a portion of the cord may be contained within one or more of the layers of the securement mechanism 750 such that the cord is hidden from view as it passes or extends between the cord housing 720 and the second cord housing 740. The securement mechanism may include various features or mechanisms that house or otherwise direct the cord from cord housing 720 to the second cord housing 740. Examples include, but are not limited to, a pipe, a tube, an indentation in one or more of the materials, etc. The cord may extend out of the second cord housing 740 and connect to a handle or other accessory such as previously described.

Figure 9B:
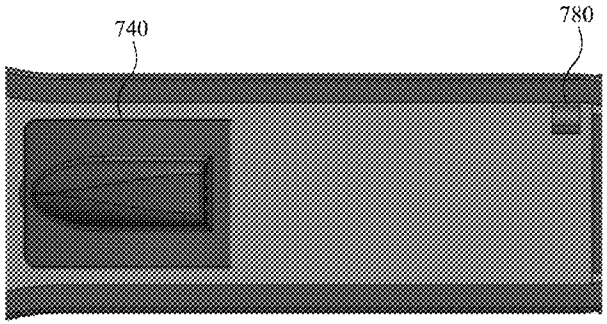
FIG. 9B illustrates a portion of the portable exercise device of FIG. 9A having an additional feature according to an example.

FIG. 9B illustrates a portion of the portable exercise device 700 of FIG. 9A having a securement loop 780 according to an example. In an example, the securement loop 780 may be made of nylon, plastic or any other suitable material. The securement loop 780 may be used to removably couple an accessory (e.g., accessory 800 (FIG. 10)) to the portable exercise device 700. For example, the securement loop 780 may be used to attach a carabiner, a clip, a clasp or other such device to the portable exercise device 700. Although a single securement loop 780 is shown, multiple securement loops 780 at a variety of different locations/positions may be provided on the portable exercise device 700.

Figure 10:
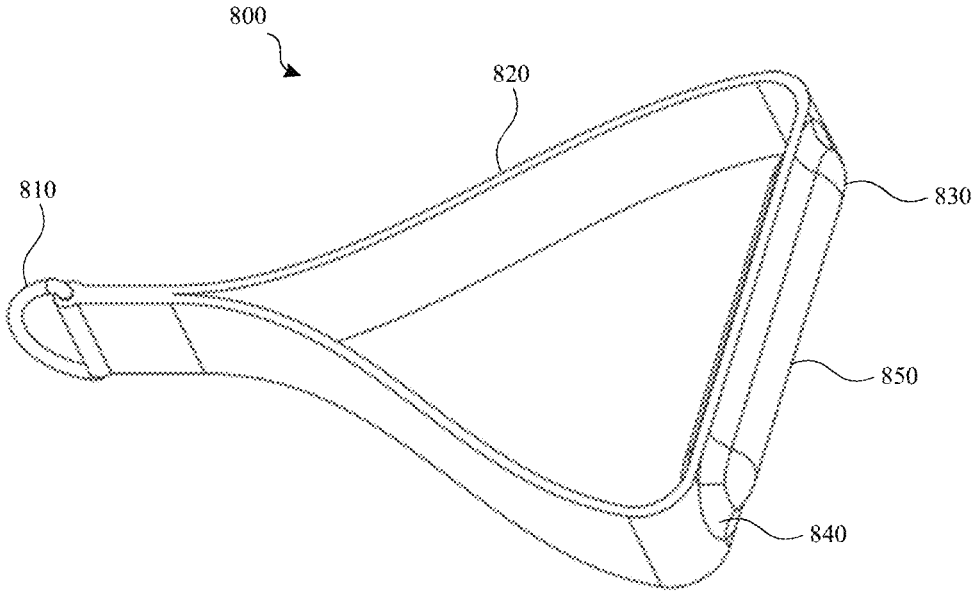
FIG. 10 illustrates an accessory that may be used with a portable exercise device according to an example.

FIG. 10 illustrates an accessory 800 that may be used with a portable exercise device according to an example. In an example, the accessory 800 is a handle. For example, the handle may be similar to the handle 160 shown and described with respect to FIG. 1A.

In an example the accessory 800 includes a ring or fastener 810 that enables the accessory 800 to be removeably coupled to a cord (e.g., cord 150 (FIG. 1A)) of the portable exercise device (e.g., portable exercise device 700 (FIG. 9A)). The fastener 810 may also enable the accessory 800 to be removeably coupled to a securement loop (e.g., securement loop 780 (FIG. 9B)).

The accessory 800 may also include a body portion 820 that extends from the fastener 810 to a handle portion 830. The body portion 820 may be comprised of nylon, plastic, rubber or any suitable material. In one example, the body portion 820 may be flexible or somewhat flexible. In another example, the body portion 820 may be rigid or substantially rigid.

The handle portion 830 may have a base portion 840 and an elevated portion 850. The base portion 840 may be used to secure the handle portion 830 to the body portion 820. The elevated portion 850 may be padded and/or weighted. In some examples, when the elevated portion includes weights, one or more weights may be added to and/or removeable from the elevated portion 850. In an example, handle portion 830 may be on a first portion (e.g., outside) of the body portion 820 and/or on a second portion (e.g., inside) of the body portion 820.

The description and illustration of one or more aspects provided in this application are not intended to limit or restrict the scope of the disclosure as claimed in any way. The aspects, examples, and details provided in this application are considered sufficient to convey possession and enable others to make and use the best mode of claimed disclosure. The claimed disclosure should not be construed as being limited to any aspect, example, or detail provided in this application. Regardless of whether shown and described in combination or separately, the various features (both structural and methodological) are intended to be selectively rearranged, included or omitted to produce an embodiment with a particular set of features. Having been provided with the description and illustration of the present application, one skilled in the art may envision variations, modifications, and alternate aspects falling within the spirit of the broader aspects of the general inventive concept embodied in this application that do not depart from the broader scope of the claimed disclosure.

The invention claimed is:

1. A resistance assembly for a portable exercise device, comprising:
- a tension mechanism adapted to rotate about an axis;
- a gear assembly comprising:
  - a plurality of stators;
  - a plurality of friction discs between the plurality of stators; and
  - a brake rotor positioned between the plurality of friction discs;
- a drive sheave rotatably coupled to a shaft, the shaft extending at least partially through a housing of the resistance assembly and mating with the brake rotor; and
- a cord housing extending from the housing, the cord housing defining an opening having a plurality of bearings secured therein, wherein a cord associated with the drive sheave extends, at least partially, through the cord housing and the plurality of bearings.

2. The resistance assembly of claim 1, wherein the gear assembly compresses in response to actuation of the tension adjustment mechanism in a first direction.

3. The resistance assembly of claim 2, wherein the gear assembly decompresses in response to actuation of the tension adjustment mechanism in a second direction that is different from the first direction.

4. The resistance assembly of claim 1, further comprising a bearing rotatably coupled to the drive sheave and the shaft.

5. The resistance assembly of claim 4, wherein the bearing is a one-way bearing.

6. The resistance assembly of claim 1, further comprising a cord adapted to unwind from and wind onto the drive sheave.

7. The resistance assembly of claim 1, wherein each of the plurality of bearings are rotatable about a respective axis.

8. A resistance assembly for a portable exercise device, comprising:
- a housing;
- a tension adjustment mechanism rotatably coupled to the housing;
- a gear assembly positioned between the housing and the tension mechanism and comprising:
  - a plurality of stators;
  - a plurality of friction discs between the plurality of stators; and
  - a brake rotor positioned between the plurality of friction discs;
- a drive sheave rotatably coupled to a shaft, the shaft extending at least partially through a portion of the housing and mating with the brake rotor; and
- a cord housing extending from the housing, the cord housing defining an opening having a plurality of bearings secured therein, wherein a cord associated with the drive sheave extends, at least partially, through the cord housing and the plurality of bearings.

9. The resistance assembly of claim 8, wherein the gear assembly compresses in response to rotation of the tension mechanism in a first direction.

10. The resistance assembly of claim 9, wherein the gear assembly decompresses in response to rotation of the tension mechanism in a second direction that is different from the first direction.

11. The resistance assembly of claim 8, wherein each of the plurality of bearings are rotatable about a respective axis.

12. The resistance assembly of claim 11, wherein each of the plurality of bearings are secured within the opening defined by the cord housing by respective shafts.

13. The resistance assembly of claim 8, wherein the housing comprises a flange extending from at least one side of the housing.

14. The resistance assembly of claim 13, wherein the flange secures the resistance assembly to a securement mechanism.

15. The resistance assembly of claim 8, further comprising a bearing rotatably coupled to the drive sheave and the shaft.

16. A resistance assembly for a portable exercise device, comprising:

a housing;

a tension mechanism rotatably coupled to an outer surface of the housing via one or more threads;

a gear assembly configured to compress and decompress in response to rotation of the tension mechanism, the gear assembly contained between the housing and the tension mechanism and comprising:

a plurality of stators;

a plurality of friction discs between the plurality of stators; and a brake rotor positioned between the plurality of friction discs;

a drive sheave rotatably coupled to a shaft, the shaft extending at least partially through a portion of the housing and mating with the brake rotor; and a cord housing extending from the housing, the cord housing defining an opening having a plurality of bearings secured therein, wherein a cord associated with the drive sheave extends, at least partially, through the cord housing and the plurality of bearings.

17. The resistance assembly of claim 16, wherein the gear assembly compresses in response to rotation of the tension mechanism in a first direction.

18. The resistance assembly of claim 17, wherein the gear assembly decompresses in response to rotation of the tension mechanism in a second direction that is different from the first direction.

* * * * *